US007002478B2

(12) United States Patent
Moore et al.

(10) Patent No.: US 7,002,478 B2
(45) Date of Patent: Feb. 21, 2006

(54) SMOKE AND FLAME DETECTION

(75) Inventors: Ian Frederick Moore, Surrey (GB); Edward Grellier Colby, Cambridge (GB); Michael John Black, Cambridge (GB)

(73) Assignee: VSD Limited, (GB)

( * ) Notice: Subject to any disclaimer, the term of this patent is extended or adjusted under 35 U.S.C. 154(b) by 0 days.

(21) Appl. No.: 10/203,589

(22) PCT Filed: Feb. 7, 2001

(86) PCT No.: PCT/GB01/00482

§ 371 (c)(1),
(2), (4) Date: Jan. 3, 2003

(87) PCT Pub. No.: WO01/57819

PCT Pub. Date: Aug. 9, 2001

(65) Prior Publication Data

US 2003/0141980 A1 Jul. 31, 2003

(30) Foreign Application Priority Data

Feb. 7, 2000 (GB) ..... 0002695
May 5, 2000 (GB) ..... 0010857
Sep. 27, 2000 (WO) ..... PCT/GB00/03717

(51) Int. Cl.
*G08B 17/12* (2006.01)

(52) U.S. Cl. ..... 340/577; 340/578; 340/579; 340/522; 340/588; 340/589; 382/100; 382/103; 382/203

(58) Field of Classification Search ..... 340/577, 340/578, 579, 522, 584, 588, 589, 600, 628, 340/629, 630; 348/143, 156; 382/103, 100, 382/203

See application file for complete search history.

(56) References Cited

U.S. PATENT DOCUMENTS

| | | | | |
|---|---|---|---|---|
| 4,999,614 A * | 3/1991 | Ueda et al. | ..... | 340/588 |
| 5,153,722 A | 10/1992 | Goedeke | ..... | 358/108 |
| 5,237,308 A | 8/1993 | Nakamura | ..... | 340/588 |
| 5,289,275 A * | 2/1994 | Ishii et al. | ..... | 348/154 |
| 5,926,280 A * | 7/1999 | Yamagishi et al. | ..... | 356/390 |
| 5,937,077 A * | 8/1999 | Chan et al. | ..... | 382/100 |
| 6,184,792 B1 * | 2/2001 | Privalov et al. | ..... | 340/578 |

FOREIGN PATENT DOCUMENTS

| | | |
|---|---|---|
| WO | 9716926 | 5/1997 |
| WO | 9965005 | 12/1999 |

OTHER PUBLICATIONS

"Production System Environment for Integrating Knowledge with Vision Data", from Spatial Reasoning & Multi-Sensor Fusion, by K.M Andress et al. (1987).
"Artificial Intelligence vol. 27" (1985).

(Continued)

*Primary Examiner*—Daniel Wu
*Assistant Examiner*—Tai T. Nguyen
(74) *Attorney, Agent, or Firm*—Ostrolenk, Faber, Gerb & Soffen, LLP

(57) ABSTRACT

A method of operating a computer for smoke and flame detection comprising the steps of: receiving digitised images of the region to be monitored; comparing pixels of one of said images with pixels of another said image according to two predetermined procedures to produce a flame present decision and a smoke present decision; and providing a fire detected signal according to said smoke present and flame present decisions.

4 Claims, 3 Drawing Sheets

OTHER PUBLICATIONS

"Signal Processing for Computer Vision" by Gösta H. Granlund, et al. (1995).
"Artificial Intelligence vol. 26" (1985).
"Pattern Recognition as to Statistical Approach" by Pierre A. Devijver, et al. (1982).
"Applied Image Processing", from MacMillan New Electronics: Introductions to Advanced Topics, by G.J. Awcock, et al. (1995).
"Digital Image Processing" by Rafael C. Gonzalez, et al. (1993).
"Development of an Economical Video Based Fire Detection and Location System", from Department of Mechanical and Materials Engineering, Washington State University, by O.A. Plumb, et al. (1996).
"Detection and Alarming of Early Appearance of Fire Using CCTV Cameras", from Nuclear Engineering International, Fire & Safety '97 Conference, by R.F. Aird, et al. (1997).
"Wormald Safety News" (1998).
"VSD Ltd. Video Smoke Detection Business Plan" (1998).
"Installation and Commissioning Guide" from VSD Video Smoke Detection, by Intelsec Systems Limited (no date).

* cited by examiner

SMOKE AND FLAME DETECTION

BACKGROUND OF THE INVENTION

The invention relates to the detection of smoke and flame using image processing technology.

It is common to install CCTV type cameras in or around buildings, transport facilities such as traffic tunnels, or industrial plants to allow centralised surveillance monitoring. These cameras can be used to detect fires and generate fire alarm information. Advantageously, such cameras can be integrated into an automatic fire detection system, which can operate entirely without human intervention thereby reducing the potential for missed alarms.

BRIEF DESCRIPTION OF THE DRAWINGS

The use of vision systems to detect smoke or flame is known. One example of a camera-based smoke detection system is disclosed in WO00/23959 (VSD Limited).

In order that the invention may be well understood, some embodiments thereof which are given by way of example only, will now be described with rerferenc to the drawings, in which.

DESCRIPTION OF A PREFERRED EMBODIMENT

Figure 1:
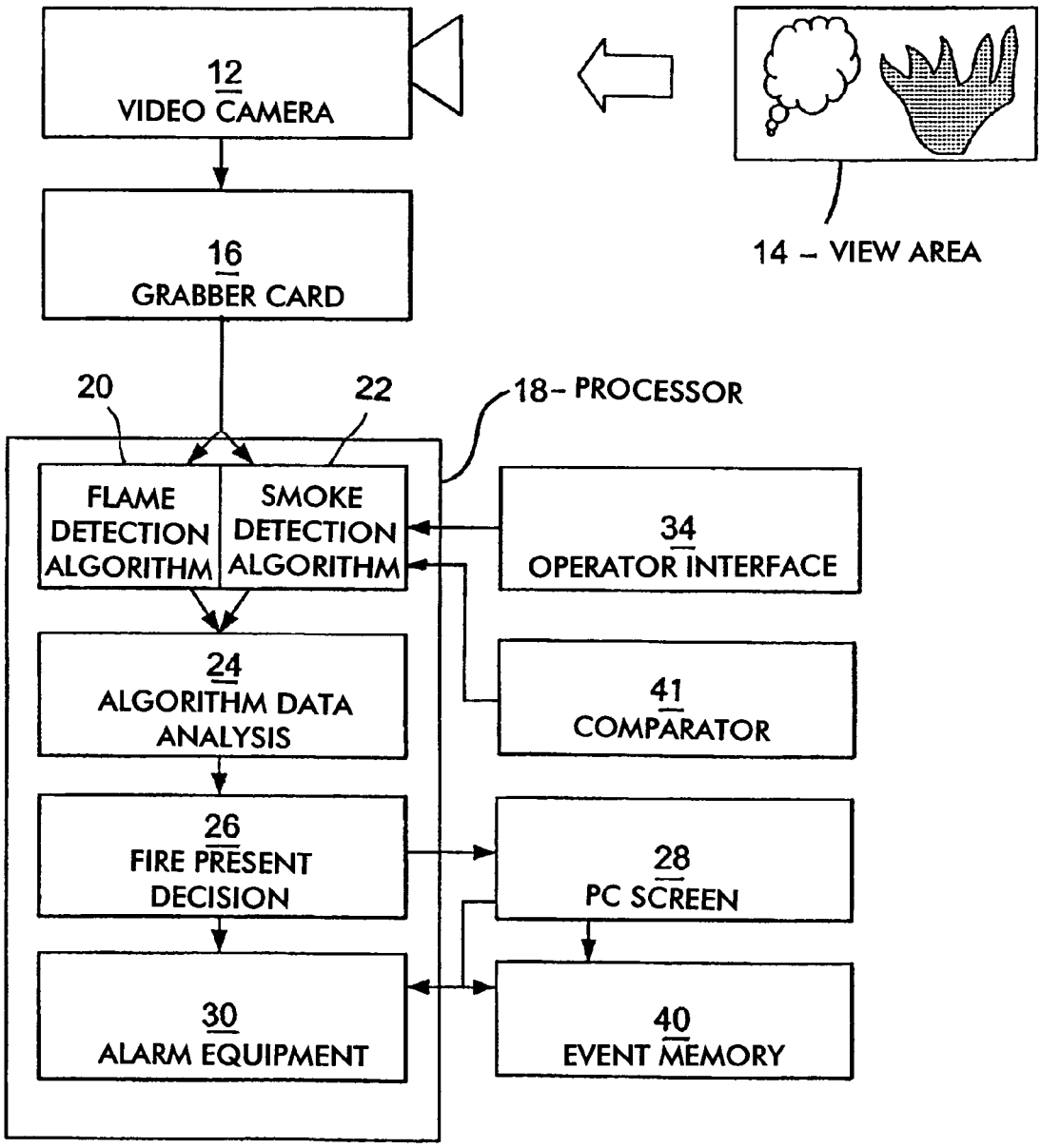
FIG. 1 is block diagram showing a smoke and flame detection system.

The smoke and flame detection system 10 comprises one or more video cameras 12 which are variously directed at one or more locations which are to be monitored. Preferably, the cameras also serve a second function as a part of a security or other form of surveilance system, although, it will be understood that one or more cameras could be dedicated solely to fire detection. In the description which follows, purely for the sake of convenience, the system will be described as having one camera 12.

The camera is directed at a region to be monitored or view area 14 and outputs a standard 625 line analogue video signal at 25 Hz frame rate. In practice, a standard video camera from the Hitachi company has proved suitable. Images of the view area 14 captured by the camera are fed to a frame grabber card 16 at a minimum frame rate of 5 Hz and preferably approximately 10 Hz. The frame grabber card digitises the images to a resolution of 640 pixels per line with 480 lines and feeds the digitised images to a processor 18 at the frame rate. The frame grabber card is a standard piece of hardware and in practice, a National Instruments PCI 1411 device plugged into the PCI bus of a standard PC has proved suitable. The grabber card may utilise Scion Image software.

It will be appreciated that the camera may be a digital camera, in which case the grabber card would not be required to digitise the image. In this case, the grabber card would merely be required to grab digitised images from the camera at the required rate and feed the images to the processor 18.

The processor 18 may comprise a standard IBM™ PC using a 750 Hz Intel Pentium 3™ processor with 128 Mb of RAM, although, it will readily be appreciated that this is just one example of many processors, which would be equally suitable.

The processor 18 processes the digitised images received from the frame grabber card using separate algorithms 20, 22 for smoke and flame detection. Details of the algorithms are provided below. The processor uses a multi-threaded processing environment, such as windows, to simultaneously run the two algorithms to detect smoke or flame areas within the digitised image.

The processor at 24 analyses the data produced by the algorithms to assess whether a fire has been detected. The processor may use a vote based analysis to assess whether a fire has been detected. For example, the processor may produce a fire detected signal if there is a yes flame present decision and a yes smoke present decision. This would provide a high level fire present indication. Alternatively, if there is only a yes decision from one algorithm, the processor may produce a lower ranked fire present indication. Yet another alternative would comprise producing a higher ranked fire present indication where both algorithms produce a yes decision and where one of the two, for example, the flame detection algorithm, produces a yes decision while the other produces a no decision and a lower ranked fire present indication where only the other algorithm produces a yes decision. This latter alternative might be advantageously utilised in an environment in which smoke emitting fires are less likely to occur and/or there is a likelihood of the occurrence of events which might trigger an erroneous yes smoke present decision; an example of such an environment might be an area of a petrochemical plant in which steam release may occur. It will of course be appreciated that such a vote based analysis might be varied in many ways and that, for example, the flame present decisions and smoke present decisions produced by the algorithms may be ranked and the fire detected vote would take account of the respective rankings in assessing whether a fire has been detected and what, if any ranking should be given to the fire present indication.

As an alternative to a vote based system, the processor may take the data produced using the algorithms and carry out a statistical analysis to asses whether a fire is detected and that such an analysis may produce an unranked fire detected indication or a ranked fire present indication. Many forms of statistical analysis could be used, including analyses referring to earlier decisions in a predetermined period, and since these will be readily apparent to those skilled in the art, no detailed description of such analyses will be provided herein.

If the decision 26 is that there is a fire, a suitable signal is output by the processor using a standard serial RS232 link. The signal can be used to provide an on-screen warning for the operator on a conventional PC screen 28. The operator is then able to make a decision as to whether or not to trigger an alarm or investigate in more detail. Alternatively, or in addition, the signal may be fed via known interface equipment, such as for example digital to analogue interfaces, to produce an alarm signal using any form of conventional alarm equipment 30. A digital alarm signal could additionally, or alternatively be directed to digital receiving means of the local fire service. It will be appreciated that the processor may select the destination of the output signal according to the rank (if any) assigned to the fire detected signal. Thus, for example, if the fire detected signal is low ranked, the processor may cause the output signal to be directed to a display and or low level warning device to alert an operator to the possibility of a fire which the operator should then investigate manually. In such a system, the processor may cause the output signal to be directed to a main alarm device if a high ranked fire detected signal is produced. Whilst it is preferred that at some level the processor would cause the output signal to be directed to an alarm device without operator intervention, it will be appreciated that the system could be configured to act simply as an operator warning system, if this is what the user requires.

The system includes an operator interface, for example a keyboard and/or mouse 34, to permit an operator to interact with the processing algorithms to customise the system by adjusting parameters employed by the algorithms in order to improve detection performance and/or reduce the incidence of false alarms. The operator interface may also permit the operator to provide commands to the system, for example to terminate an alarm which is deemed a false alarm. The operator may for example adjust the system so that it ignores certain zones in a particular view area or assign differing detection parameters to various portions of the view area. Alternative forms of display and input device for the system would include a touch screen. It will also be appreciated that the system may be provided without an operator input device where it is considered that operator access to the algorithms is unnecessary or undesirable. In this case, the system could be configured to receive data and commands from a suitable portable computing device to enable set up and diagnostic work to be carried out by authorised personnel.

The system may include an event memory 40, which may be an integral part of the processor or a standalone memory. This event memory could be used to hold images showing the view area 14 at the time a fire detection signal is produced. Such images may be used to assist in fine tuning the system, where for example a significant number of false alarms or operator warnings have been produced, or to provide evidence as to the lime, location and/or cause of a particular fire. It will be appreciated that the system may be configured such that an image is recorded in the event memory 40 in response to commands from the processor and/or instructions from the operator.

The use of multi-threaded processing allows one software program and one processor to simultaneously process the smoke and fire detection algorithms and also multiple video channels. It will be appreciated that more than one processor may be used to improve processing speed.

The use of simultaneous smoke and flame detection improves the ability of the system to provide adequate responses to a detected event whether the event is an instantaneous igntion type fire where there may be little or no smoke or slow progressing fires such as the type that emit smoke. For example, if the system detects smoke without flame in a zone where there is the possibility of a steam leak triggering an initial smoke detection signal, an alarm event can be prevented and/or delayed pending detection of flame. Alternatively, in environments where a flame detection may be triggered without the presence of fire, for example, where conventional sodium lighting is present, an alarm signal may be delayed pending the detection of smoke. Thus the system provides greater flexibility and sensitivity when compared with systems capable of detecting smoke alone or flame alone. It will be appreciated that since the system can simultaneously monitor for the presence of smoke and flame, it can detect all types of fire, whether they be instantaneous ignition type fires or slow burning fires that emit smoke.

Figure 2:
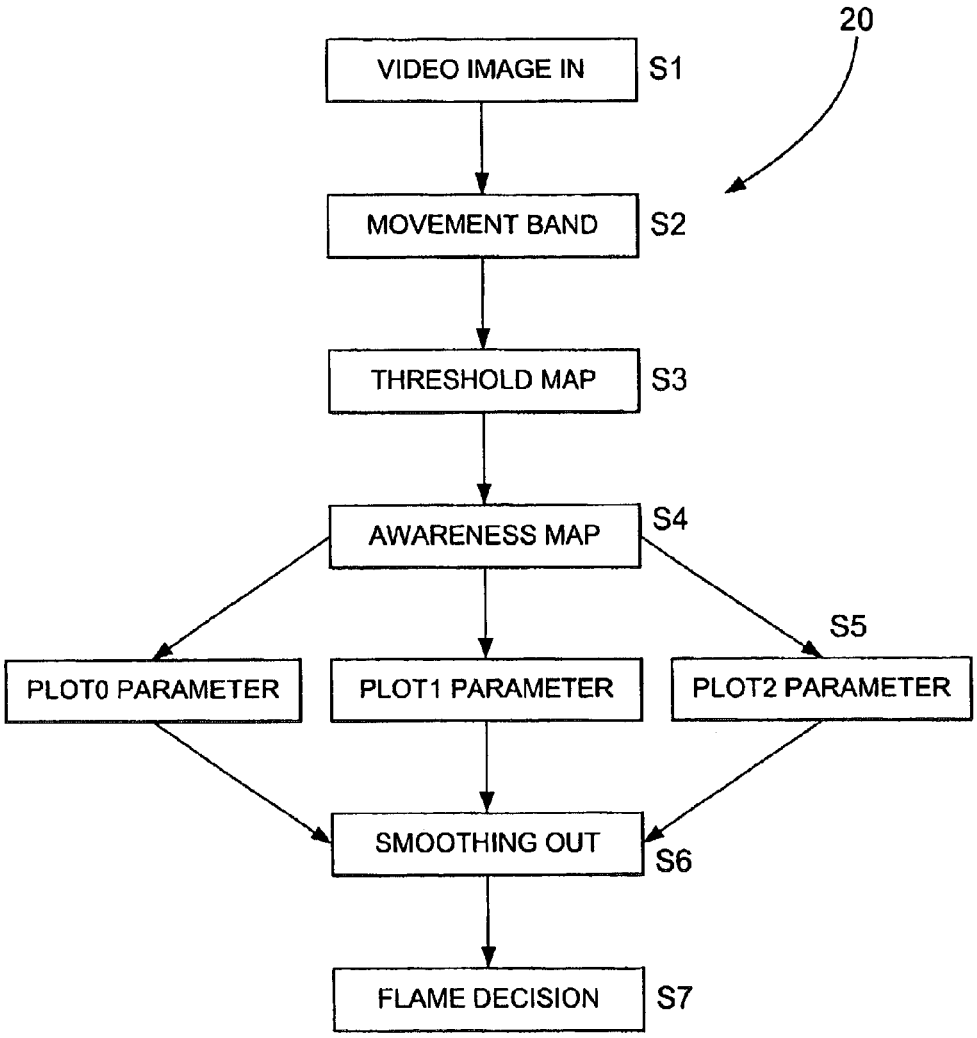
FIG. 2 is a block diagram showing steps an algorithm used by the system shown in FIG. 1.

The fire detection algorithm 20 used by the processor to detect the presence of flame will now be described with reference to FIG. 2. The algorithm is coded in a mixture of LabView™ and Microsoft® Visual ++. The fire detection algorithm comprises a series of steps labelled S1 to S7.

In step S1, the video image is entered into the algorithm in the form of a monochrome 640×480 image where each image pixel has an intensity value of 8 bits resolution. The algorithm processes each pixel individually, using linear mathematical operations.

In step S2, the monochrome 640×480 8 bit image is used to generate two separate averaged 640×480 8 bit resolution images which filter out rapidly occurring events, one with filter set at 1.25 Hz and the other with the filter set at 4.0 Hz. The absolute difference between pixel values of these two images is then taken to obtain a movement band 640×480 8 bit image, which displays entities that are moving in the image within the frequency band between 1.25 and 4.0 Hz. This frequency band corresponds with the range of movement frequencies exhibited by petrol flames observed empirically.

In the first averaged image, a dimensionless time constant k1 is used to generate a 640×480 8 bit image that filters out events that occur more rapidly than 4 Hz.

k1 is calculated according to the relationship:

$$k1=1/(4\ \text{Hz}\times\text{time in seconds between successive frames})$$

k1 is then used to generate an image that filters out events that occur at higher frequencies than 4 Hz in the following manner:

$$pM1=k1\times(\text{live pixel image value})+(\text{value of } pM1 \text{ from previous frame})$$

where pM1 is a rolling average with a starting value of zero. Each pixel in the 640×480 live image has a corresponding value of pM1 which can be used to make up the averaged image.

In the second averaged image, a dimensionless time constant k2, is used to generate a 640×480 resolution 8 bit image that filters out events that occur more rapidly than 1.25 Hz.

k2 is calculated in the following relationship:

$$k2=1/(1.25\ \text{Hz}\times\text{time in seconds between successive frames})$$

k2 is then used to generate an image that filters out events that occur at higher frequencies than 1.25 Hz in the following manner:

$$pM2=k2\times(\text{live pixel image value})+(1-k2)\times(\text{value of } pM2 \text{ from previous frame})$$

where pM2 is a rolling average with a stating value of zero. Each pixel in the 640×480 image has corresponding value of pM2 which can be used to make up the averaged image.

Once the two 640×480 time filtered images with pixel values equal to pM1 and pM2 have been generated, a so-called movement band 640×480 resolution image is generated by taking each of the pixels of these averaged images and calculating the absolute difference between pM1 and pM2 by finding the magnitude of the difference between each of the individual pixels obtained by subtracting pM1 from pM2. In this manner, a 640×480 image is obtained which only displays events that occur in the frequency band between 1.25 Hz and 4.0 Hz. Each pixel of the movement band image has an 8 bit resolution.

In step S3, once an image has been filtered using the movement band, the filtered image has a threshold applied to create a map of significant movement in the characteristic frequency band defined by k1 and k2. The study of the temporal dynamics of these highlighted pixels is used to decide whether or not flames are present in the video image. The best value for this threshold based on the observation of outdoor petrol flames is equal to a value of 5% of the dynamic range of values, in the 640×480 8 bit movement band image, is t1=13, rounded up to the nearest whole number. In the application written in LabView™, the user of the system can set this value to an arbitrary value between 0 and 255 using the graphical user interface provided by LabView™. If a pixel value of the movement band image is greater than the threshold value, it is entered as 1 into the threshold map. If a pixel value of the movement band image is lower than the threshold value it is entered as 0 into the threshold map. The threshold map is a Boolean image of 640×480 pixels where non-thresholded pixels have a value of zero, and threshold pixels have a value of one.

In step S4, the 'awareness map' is a subset of the 'threshold map'. In order to generate the awareness map, each pixel in the threshold amp defined in step S3 has an awareness level, which is an indication of the likelihood of the flame existing within that particular pixel. If the awareness level, increases above a user-defined threshold defined as the integer t2 (nominal value of 40), then the threshold pixel is registered with binary value 1, into the awareness map.

The awareness map is a 640×480 Boolean image. An integer defined as the awareness level is generated for each of the pixels in the awareness map. The value of the awareness level is calculated by comparing successive frames of the awareness map for each of the pixels is equal to zero.

If a pixel in the awareness map changes from 1 to 0 or changes from 0 to 1 between successive video frames, then 2 is added to the value of the awareness level for that pixel. If pixel in the awareness map does not change (ie stays at 0 or stays at 1) between successive frames, then 1 is subtracted from the awareness level. The minimum value of the awareness level is zero ie if the awareness level becomes negative it is immediately set to zero.

This means that flickering movements within the frequency band defined by k1 and k2 will cause a rapid increase in the awareness level for each individual pixel. These flickering movements have been observed to be characteristic of flame.

In step S5, a number of parameters are calculated so that the algorithm can decide whether a flame is present in the video images that are being processed. These parameters may be plotted in a moving graph or used to determine a confidence of a flame detection event. The Plot0 parameter is a constant equal to an integer called the Alarm Level, user defined with a default value of 20. A flame is registered in the system when the Plot2 parameter described below exceeds the Alarm Level, which has a nominal value of 20. Low values of Alarm Level mean that the algorithm is fast to react to possible flames in the digitised image, but is susceptible to false detected decisions. High values of Alarm Level mean that the algorithm is insensitive to false flame detected decisions, but is slow to react to possible flames in the digitised image.

The Plot1 and Plot2 parameters are calculated in the following manner by scanning horizontally across the awareness map. As the scan is performed from left to right across each horizontal line of the awareness map the values of adjacent pixels are compared and a value is entered into an edge counter that starts at a value of zero. If adjacent pixels are equal to one another then nothing is added to the edge counter. If adjacent pixels are not equal to one another then 1 is added to the edge counter. At the same time, the total number of pixels with the binary value 1 is counted and added into a pixel counter. This operation is performed for each of the 480 lines of the image (from top to bottom) and the values for the edge counter and the pixel counter are summed. At the end of this procedure two integers have been calculated. These are:

Edgesum=Sum of horizontal edge transitions in awareness map

Pixelsum=Total number of pixels with binary value 1 in the awareness map

In parallel with this, the coordinates of the pixels with binary value 1 are noted. A region of interest is defined by noting the following quantities:

x1=Minimum x coordinate x2=Maximum x coordinate y1=Minimum y coordinate y2=Maximum y coordinate The area of the region of interest is defined as:

$$ROI\text{area}=(x2-x4)\times(y2-y1)$$

The Plot1 parameter is calculated as follows:

$$\text{Plot1}=(\text{Pixelsum}-\text{Edgesum})/ROI\text{area}$$

This is a measure of the sparseness of the flicker in the image, and can be used to discriminate between treelike objects and more densely packed flame like objects. If Plot1 is less than zero then the image is sparse and if Plot1 is greater than zero the image is dense.

The Plot2 parameter is calculated as follows:

$$\text{Plot2}=\text{Pixelsum}/\text{ROIarea}$$

In step S6, prior to performing the final flame decision, the 'plot' parameters described above are smoothed using a user defined dimensionless time constant k3 with a time constant of 8.0 seconds. K3 is calculated in the following manner:

$$k3=8.0\ \text{s}/(\text{time in seconds between successive frames})$$

k3 is applied between successive values of Plot1 and Plot2 obtained from successive video images using the same filtering techniques as used by k1 and k2 described above. This reduces the noise level in the plotted parameters and reduces the false alarm rate. The decision whether a flame is occurring within the video image has two operator selectable modes; normal mode and tree filter mode Normal flame decision mode is employed when no treelike objects are in the picture. In this mode, Plot1 is ignored. Here, an alarm is triggered when the Plot2 parameter is greater than the user Plot0 parameter.

In tree filter mode, it was found that the flicker movement detected by the algorithm was sparsely distributed for a treelike object and densely distributed for a fire. A positive value of Plot1 indicates a densely packed arrangement of flickering pixels (ie a flame) and a negative value of Plot1 indicates a sparsely packed arrangement of flickering pixels (ie leaves on a tree moving in the wind).

The alarm for a flame with the tree filter only occurs when Plot2 is greater than the Plot0 and Plot1 is greater than zero.

The inventors have found that inclusion of the tree filter increases the selectivity of the system, but also increases the amount of time required to reach a decision on whether a flame is present in the picture.

The algorithm described above has been optimised by empirical methods and the constants determining the function of the algorithm may be chosen to achieve optimum results within the scene environment.

Further it can be seen that systems comprising colour video images, or with differing pixel resolutions may be processed by such an algorithm and extensions to the algorithm will be obvious to those skilled in the art.

An example of a suitable smoke detection algorithm 22 will now be described. For the purposes of this algorithm, the processor includes a comparator 41, which analyses the differences between different images and the pixels which make up the images. For this purpose, the comparator first compares the image with previous images and by subtraction obtains a signal representative of the difference between successive images. The system also includes an adjustable threshold control level for sensitivity setting and a means by which changes which are representative of signal noise can be eliminated.

The output of the comparator is then subjected to the main processing of the signal in accordance with the smoke detection algorithm. Essentially the processor is looking to see whether there are changes in the individual pixels of a frame and in the differences between adjacent pixels which would have been caused by smoke particles Now the processor involves a number of separate analyses and these involve mathematical analysis by appropriate computer software in the signal process as part of the equipment.

The signal processing means has to include hardware and/or software to recognise the selected conditions of change so that the presence of a smoke condition can be identified.

The analysis can be based on the following:

Notation and Concepts

The system has two images to work with, where image is defined as an ordered set of pixels intensities.

First it is necessary to define the set of possible pixel intensity values $$Z=<0,1,2,3, \ldots ,M>$$

where M is the maximum pixel value.

An image is defined as an ordered set of pixel values where a pixel value is defined as:

$$i_j \epsilon Z$$

Therefore an image can be denoted as follows $$I=<i_0,i_1,i_2,i_3,i_4, \ldots ,i_N>$$

Where N is the number of pixels in an image.

The system provides two images in order to evaluate the various changes. These images are R the reference image C the current image Given that a change has been identified this change is used to define a sub-set of the images.

$$R_\Delta \subseteq R$$

$$C_\Delta \subseteq C$$

With these sub-sets defined, the following metrics are evaluated:

Convergence to a common mean

There is the reference image R and the current image C. The set of pixels which are deemed to have changed are denoted $C_\Delta$ and $R_\Delta$.

Let m be the mean value of the changes in C i.e.

$$m = \frac{1}{\#C_\Delta} \sum C_\Delta$$

where

#S denotes the number of element in the ordered set S and ΣS denotes the sum of all elements in the ordered set S.

Once the value m has been defined the number of pixels whose intensity is approaching m with respect their corresponding value in the reference image is evaluated. With the same images the number of pixels whose intensities are departing from this mean value is also calculated.

$$''\text{towards}=\Sigma\{\text{sign}(C_-R_)=\text{sign}(C_-m)\}$$

$$''\text{away}=\Sigma\{\text{sign}(C_-R_)\neq\text{sign}(C_-m)\}$$

where the function sign is defined as follows for scalar values, when applied to an ordered set it is $$\text{sign}(x) \rightarrow \begin{array}{l} x<0:\ -1 \\ x=0:\ 0 \\ x>0:\ 1 \end{array}$$

defined to return an ordered set of values.

These two values provide a metric of "convergence to the common mean value" and passed forward to the decision system.

Static Becomes Dynamic

For any area which is being investigated, the consistency of the changing area is evaluated over time in order to assess if that area is dynamic in terms of its overall appearance or static. Lighting changes alter the image but the overall appearance does not change. The correlation function is used to evaluate this similarity over time since it is invariant to both scale and gain changes. If an object obscures the background by moving into the area of interest then the appearance within the area of interest will change. If the correlation fluctuates sufficiently over time then the area is deemed to be dynamic. This measure of consistency is forwarded to the decision system.

Edge Content

A change in edge information is defined as a change in the value of the edge measure. The edge measure is defined as the sum of the responses of a standard derivative filter kernel where changes have been detected by the previous stage. A standard filter which is employed is the Sobel edge filter. This measure of edge content is forwarded to the decision system.

Characteristics of Shape

Various shape characteristics are employed including density and aspect ratio.

Density is defined as the average number of occupied neighbours for all members of the change set. A "four connectivity" scheme is adapted and consequently the average value of density lies in the range 0 to 4.

The aspect ratio is the ratio of the height to the width of the changed region.

When the density, aspect ratio and pixel count (i.e. the number of pixels that have changed in an area) are taken together they describe some of the shape characteristics of the changed area. These values are forwarded to the decision system.

System Description

The smoke detection software is written in C++, compiled using the WATCOM C++ compiler. The features of the software described below are encapsulated in around 50 source code files and a further 50 header files, comprising an estimated 40,000 lines of code in all.

Overview of Smoke Detection Algorithm

The smoke detection algorithm examines, in general terms, the following features of a digitised video stream to determine whether smoke has been detected:

Pixels (or groups of pixels) moving towards a mean value

Edge information edge definition—this may increase or decrease as smoke emerges (depending on what it was like before)

Whether the image overall is static or dynamic

Emerging new shapes in the image—comparison of characteristic shape with indicative smoke shapes The system works out the differences between the current image and a reference image. Important parts of the analysis are as follows:

Where image pixels appear to have changed, the algorithms work out whether the image pixels are approaching or deviating from some common mean value Edges—sum of responses of a standard deviation filter where changes were previously detected (the Sobel edge filter)

Correlation function to determine similarity over time.

Shape: density of the "changed" region—four nearest neighbours possible; aspect ratio; total area Zones Zones are rectangular regions selected from the entire image by the user when the system is installed. These would typically be arranged to cover likely areas where smoke might be produced, and (more importantly) not cover problem areas of the scene. Each zone is processed entirely separately, and the outputs from each zone may be combined to generate alarms as required. Pixels in the zone may additionally be eliminated so that they are not included in the calculations—for example, the filament of a light bulb, or a shiny metal object that glints in the sunlight. Again, these are selected by the user when the system is commissioned. At any one time there are two primary sets of image data for the zone—the current image and the reference image. The pixels in these images arc denoted by x and $x_r$ respectively, in the discussions below.

Within each zone, a set of n parameters are calculated. These parameters are formed into an n-dimensional "vector", defining a "feature" space.

Image Data (Planes) Stored in the Program

The following key image plane sets are stored by the software for each zone:

| | |
|---|---|
| current | image data |
| reference | reference image data |
| change | raw changed pixels |
| environment | edge-sensitive detector values from reference image data |
| filter | the combined "mask" |
| previous | previous value of "filter" |
| eliminate | mask of pixels eliminated manually |

Images are acquired from the grabber card on a regular basis. After any adjustments to normalise the brightness and contrast, the system compares the most recently acquired image (current) with the reference image. If pixels differ by more than an adjustable threshold (camera noise may be taken into account too), then the pixel is deemed to have changed.

The reference image is acquired periodically, when the system has detected no changes in the scene, and when the system determines that the current scene is no longer similar enough to the reference image. This reference image is analysed to generate an "environment mask", using the EDGE algorithm below. This essentially indicates where there is edge detail in the zone.

A pixel-by-pixel "filter" mask, used in the calculations detailed below, is constructed by combining the changed pixels with the environment mask. The changed pixel mask is only copied to the final filter mask at points where the magnitude of the difference between the current and the reference pixel exceeds the edge detail pixel value. Pixels selected manually as being problematic are also eliminated from this mask at this stage.

Low-Level Image Processing Operations

A large set of different image processing operations are carried out on the zone image data. Some of these operations use only the unmasked pixels, others operate on the entire set of pixels. These parameters are the raw data fed into the final smoke detection algorithms. They are all relatively straightforward image processing primitives, but the definitions used in the algorithm are reproduced below for completeness.

MEAN

This is the simple mean value of the N pixel values, x, in the zone.

$$MEAN = (x) = \frac{\sum x}{N}$$

TOWARDS_COMMON_MEAN

This parameter counts the number of unmasked pixels in the image that deviate from the mean with the same sign as they do in the reference image.

$$\text{TOWARDS}=\Sigma[\text{sign}(x-x_r)=\text{sign}((x)-x_r)]$$

FROM_COMMON_MEAN

This parameter counts the number of unmasked pixels in the image that deviate from the mean with the opposite sign from the way they do in the reference image.

$$\text{FROM}=\Sigma[\text{sign}(x-x_r)=\text{sign}((x)-x_r)]$$

COFGX

The mean x-co-ordinate of the unmasked pixels in the zone (this will change as areas in the zone are masked out)

COFGY

The mean y-co-ordinate of the unmasked pixels in the zone (this will change as areas in the zone are masked out)

SIZE

The total number of pixels in the zone, including the masked pixels.

COUNT

The total number of unmasked pixels in the zone (i.e. excluding the masked pixels)

EDGE

The edge content algorithm looks at, for each unmasked pixel in the current image, the four adjacent pixels (up/down/left/right). It sums the sum of the magnitude of the differences between the left and right, and between the up and down pixels, for pixels where this exceeds a threshold value set by the user.

$$\text{EDGE}=\Sigma[\{|x_{up}-x_{down}|+|x_{left}-x_{right}|\}(\text{if}>\text{threshold})]$$

EDGE_REF

The calculates the EDGE function, but based on the reference image pixels, instead of the current image pixels

CORRELATION

This is the correlation between the reference and the current image. This is calculated as:

$$CORR=\frac{\left(N*\sum xx_r-\sum x\sum x_r\right)}{\sqrt{(N*\sum x^2-(\sum x)^2)\times(N*\sum x_r^2-(\sum x)^2)}}$$

The correlation function is used as an overall "gate" to the detection process. If this correlation is greater than a preset SIMILARITY, then no further processing is carried out on the zone. This corresponds to the case where the image is essentially the same as the reference image.

CORRELATION_MASKED

The masked correlation calculates the same function as the correlation function above, considering only those pixels that are not masked.

VARIANCE

This is the standard variance of the pixel value, x, including all the pixels, calculated as $$VAR=(x^2)-(x)^2=\frac{\sum x^2}{N}-\left(\frac{\sum x}{N}\right)^2$$

VARIANCE_REF

This is the standard variance of the reference pixel values, $x_r$, including all the pixels, calculated as $$VAR=(x_r^2)-(x_r)^2=\frac{\sum x_r^2}{N}-\left(\frac{\sum x_r}{N}\right)^2$$

SKEW, KURTOSIS and FIFTH

These parameters look at the distribution of all the pixel values in the current image. As an example, the pixel values might have a Gaussian distribution about the mean pixel value, or the distribution might be asymmetric or otherwise non-Gaussian. Parameters such as skew, kurtosis and fifth are well known parameters used in statistics to analyse the non-Gaussian nature of distributions. They are calculated as follows:

Denoting $$SKEW=\frac{1}{N}\sum\left[\frac{x-(x)}{\sigma}\right]^3$$

$$KURTOSIS=\frac{1}{N}\sum\left[\frac{x-(x)}{\sigma}\right]^4$$

$$FIFTH=\frac{1}{N}\sum\left[\frac{x-(x)}{\sigma}\right]^5$$

SKEW_REF, KURTOSIS_REF and FIFTH_REF

These look at the distribution, as above, in the reference image instead of the current image.

COMPACTNESS

This function looks at the four nearest pixels to each unmasked pixel, and calculates the mean number of these that are unmasked.

Opacity is calculated, for the unmasked pixels only, as $$\frac{1}{N}\sum\left[\frac{x-x_r}{(x)-x_r}\right]$$

RUNNING_CORRELATION_MEAN

This is the standard deviation of the CORRELATION as defined above. This is a running mean, as it is simply calculated from a set of total running sums.

RUNNING_MEAN_MEAN

This is the mean value of the masked correlation—as a running value.

EDGE_EVIDENCE_EVIDENCE

This is based on a mask of particular edges in the image. This mask is shrunk by one or two pixels all round. The unmasked pixels in the current and reference images are examined using the EDGE algorithm above. The routine then calculates the mean ratio of the pixels in the EDGE'd current image and those in the EDGE'd reference image, within the unmasked region, provided that the reference image contained a non-zero value.

PERCENTAGE_CHANGE_CHANGE

This is a measure of the percentage change in the number of masked pixels between the previous "filter" mask and the present one. These are Boolean masks, and the percentage change is calculated simply on the basis of the numbers of pixels that are non-zero (TRUE) in just one of the two images, normalised by the number that are non-zero in either or both.

The filter masks are "eroded" before this calculation, using an algorithm that only allows TRUE pixels to remain if all of its original four neighbours were also TRUE. This is a form of filtering to reduce the noise.

Rule-Based Analysis

Rule-based analysis is used initially to determine whether a change in the image has occurred, and whether this change is significant. If it is, then further analysis is carried out to see if the change is considered to be associated with smoke, or whether it is associated with, say, a person walking across the scene.

The rule-based analysis uses a scoring system, where points are allocated for each rule which is met. If the points total exceeds a (variable) criteria (typically 90% of the maximum score), the analysis moves to the next level.

The analysis is carried out on a region, which is a subset of the area of the zone, defined by the edges of the unmasked pixels.

Check for No Correlation

If the running correlation for this zone is very small (RUNNING_CORRELATION_MEAN<0.1), this means that the reference image and the current image are no longer similar (e.g. because the camera moved). If the image is not changing (PERCENTAGE_CHANGE<0.3), then it is time to update the zone's reference image, and abandon the current check for smoke.

Correlation Less than Thresholdless

If the correlation is less than the user-defined threshold, two points arc scored, otherwise the check is abandoned.

Towards or from Common Mean

If the pixel values are tending towards the common mean, then this could indicate the presence of smoke (the whole image is becoming uniform grey). The algorithm looks at the ratio of the towards to from terms, and if this exceeds a user-adjustable ratio, three points are scored.

Edge-Ness-Ness

The "edge-ness" of the region is the ratio of the EDGES to the COUNT of pixels in the image. This is calculated both for the current and the reference image. If the current image edge-ness is outside a preset band, three points are scored. An additional three points are scored if the edge-ness deviates from the reference edge-ness by more than a preset percentage—selectably either up or down.

Compactness

The COMPACTNESS (defined above) must lie within a preset band. If it deviates outside of this, three points are scored.

Edge Evidence

The EDGE_EVIDENCE is decreased by the presence of smoke. If it falls below a preset threshold, three points are scored.

Scoring Against Criteria

The user may determine, when setting up the system, a subset of the available tests to carry out. The maximum score will be less, and the is take into account when determining whether the score has exceeded 90% of the maximum value. If it has, a Bayesian analysis is then carried out.

Bayesian Analysis

Bayesian analysis provides a well founded decision criteria which takes into account the co-variance of features and provides the ability to discriminate between different classes of event (nuisance and real alarms). An important fact to note when defining features for use with Bayesian analysis is that they should be invariant to external influences such as background and lighting. The algorithm can cope with some variation but in general the effects of external influences should be kept to a minimum.

Bayesian statistics are a useful tool in making decisions with multivariate systems such as this. The parameters (MEAN, TOWARDS_COMMON_MEAN etc) are combined together into an n-dimensional vector. These vectors are used to "train" the system by building up a set of statistics. More specifically, the system stores data for nuisance and real alarms as separate classes. For an n-dimensional vector v the sums s and S are calculated for N different alarm events as follows, separately for nuisance and real alarms.

$$s=\Sigma v$$

$$S=\Sigma v_v^T$$

The Bayesian decision function takes a vector, v, from the current zone/region, and calculates a real decision value, d, as follows:

$$m=\frac{s}{N}$$

$$C=\frac{S}{N}-mm^T$$

$$d=0.5\times(\log|C|+(v-m)^TC^{-1}\cdot(v-m))$$

d is calculated against the two reference classes—nuisance and real, giving $d_n$ and $d_r$ If $d_r$ is greater than $d_n$, the Bayesian analysis signals an alarm condition.

If problems are experienced with overlapping responses in $d_n$ and $d_r$, this might be solved by increasing the number of features and hence moving a to higher dimensional spaces (the probability of clouds overlapping by chance reduces as the dimensionality is increased).

Combination of Rules and Bayesian Analysis

It is crucial that the smoke detection system avoids false alarms. This is a key part of the system.

Thus an important feature of the algorithm is to combine a rule-based analysis with a statistically based analysis, and particularly with one based on Bayesian analysis. The rule based analysis takes place first and if certain criteria are met then the Bayesian analysis is instigated.

Frequently, the Bayesian analysis and the rule-based analysis disagree. In this case, the confidence in the Bayesian analysis is used to determine whether the alarm is real or nuisance. The difference between real and nuisance is based on experience and the system builds up in accuracy over time.

If the Bayesian analysis showed an alarm, but the rule-based analysis did not. The difference between the values of $d_r$ and $d_n$ is used as a measure of the confidence in the alarm. If this exceeds the minimum confidence level, then an alarm is signalled, even though the rule-based analysis did not trigger and alarm If the rule based analysis showed an alarm, and the Bayesian treatment did not, if the difference between $d_n$ and $d_r$ is more than the minimum confidence level, the alarm is cancelled.

If there is no alarm, but the correlation between the current and reference images is small, and the percentage change function is low, the reference image is updated. This effectively adjusts for changes in, for example, lighting level.

Although, the Bayesian analysis is important in avoiding false alarms, it is envisaged that in certain circumstances the smoke detection algorithm may omit a second level of analysis and instead rely on the output of the flame detection algorithm as a means for reducing the incidence of false alarms.

Figure 3:
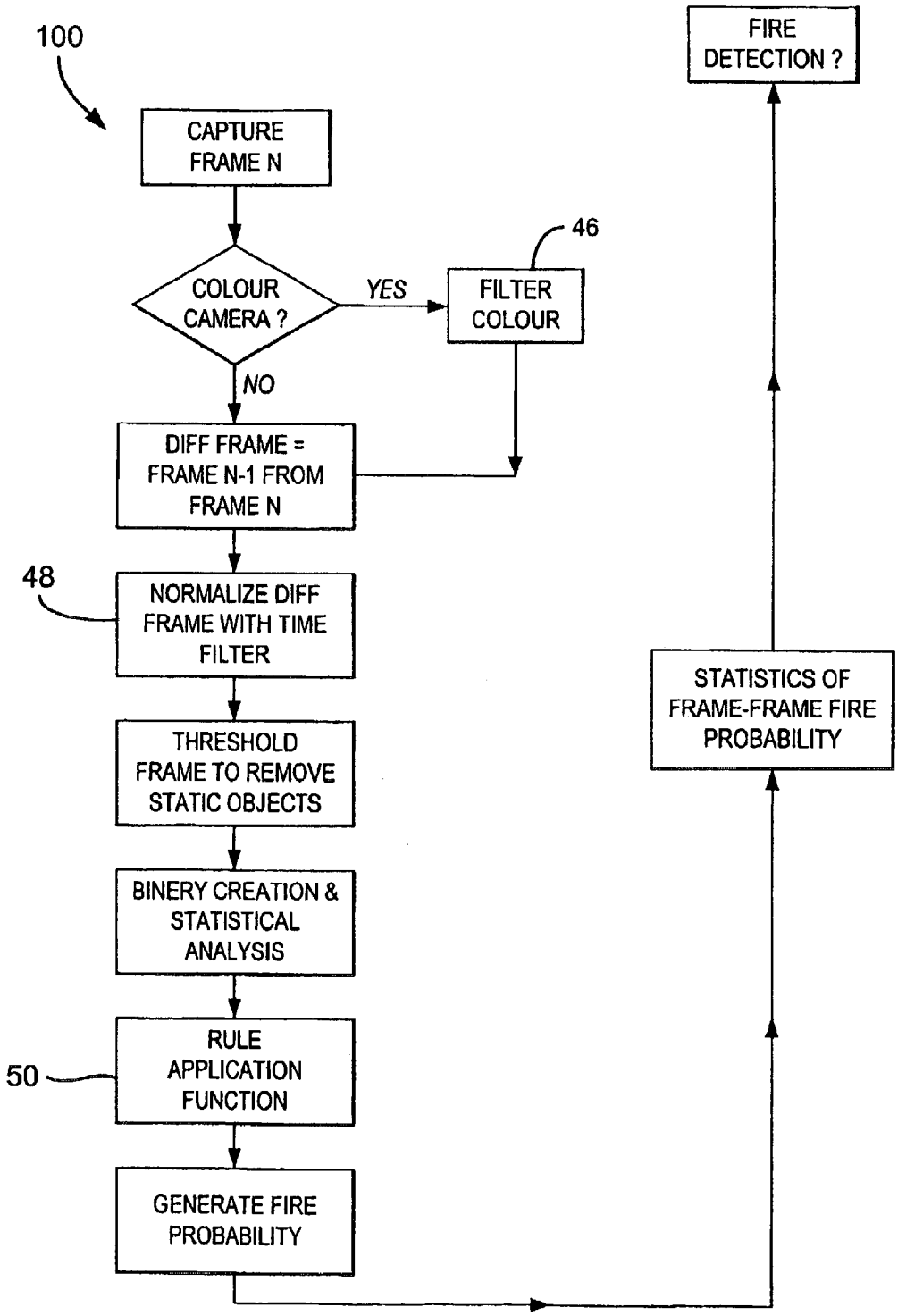
FIG. 3 is a block diagram showing another algorithm for use in a flame and smoke detection system.

A fire detection algorithm 100 is shown in FIG. 3. The algorithm is specified in general terms and some steps may utilise one or more steps either or both of the flame detection algorithm and the smoke detection algorithm 20 described above. The individual steps which comprise the algorithm 100 are indicated in FIG. 3. In general terms, the algorithm analyses moving components in the images received by the processor by examining the difference between successive images or a current image and a reference image which depicts a no-fire event condition. The total perimeter area, position and density of the resulting patterns can then be combined with one another to generate quantitative estimates of certain fire attributes in order to produce a flame detected decision. To first order, it is possible to obtain an estimate of the probability of flame occurring by adding these estimates, or parameters, together for each difference frame.

A list of fire attributes which video images of fires possess and can be used to determine whether a fire is occurring within an image comprises:

1 Fires emit light in a well defined 'blackbody' distribution;
2 The shape of a fire changes as a function of time;
3 The shape of a fire has a complicated 'fractal' structure;
4 Individual tongues of flame propagate with a high velocity;
5 Convection of heat flow causes fires to move in a general upwards direction; and
6 Smoke is generated by fire.

As indicated in FIG. 3, the fire detection algorithm may use a colour camera and the algorithm includes the step of determining whether the image to be processed is from a colour camera. If it is, a colour filter can take information from the red, green and blue channels to see if the image includes the spectral characteristics of a blackbody radiating between 2000K and 3000K. Since CCTV are also sensitive to near IR(≅900 nm), this information can also be gathered for comparison with a suitable filter.

A time filter 48 is obtained by adding 1−P times a starting reference image to P times the Nth image where P is a real number between 0 and 1. If P=1, there is no time filtering. If P=0.5, the time filtered image is insensitive to rapid changes in the frame. If P=0, only the reference image is used. The starting reference image is typically a snapshot of the view area 14 when nothing is happening. Subsequent application of this image provides a reference scene which includes gradual changes like nightfall, but ignores rapid changes like the start of a fire. In practice, values of P=10% or 5%.

The rule application function 50 applies a linear combination of statistical parameters. To first order determination, a sum of area, perimeter and number of moving particles is used.

Various aspects of the invention may include

A flame detection algorithm that processes a sequence of video images to detect sequences of images of flames;

A system implementing the flame detection algorithm comprising a video source, a frame grabber and a processor and means to trigger an external alarm when flame is detected;

An algorithm for filtering live or recorded video images so that changes with a well defined frequency band, characteristic of flame activity, are registered;

An algorithm that classifies changes in a sequence of images between flicker like behaviour and non-flicker like behaviour;

An algorithm comprising filters yielding a binary image of areas of flame like behaviour in a sequence of images;

An algorithm to compute the parameters of sparseness and edge to volume ratio in such a binary image;

A further algorithm that determines on the basis of values returned by such an algorithm whether or not to sound an alarm;

An optimal set of parameters for such algorithms; and

An algorithm which successively uses one or more of the above recited algorithms to generate parameters which can be used to decide whether a flame is occurring in a picture and can differentiate between trees moving in the wind and flames.

Various of the applicants have filed patent applications concerning fire detection. Those applications are:

It has been found that the smoke detection algorithm alone or in combination with the flame detection algorithm can be used in a gas detection system. For example, by suitable modification of the alogorithm(s), steam could be detected. Steam would initially be detected as a presence similar to smoke. However, steam will tend to evaporate and should fail to be detected in subsequent detection sequences. Thus a relatively short duration of yes smoke detected indications could indicate a detection of steam rather than smoke. A no flame detected indication in combination with smoke detected could also be indicative of gas rather than smoke/fire detection.

The content of those applications are herein incorporated by reference and the applicant reserves the right to copy material from one or more of those applications into this application and claim one or more features or combinations features from those applications either alone or in combination with one or more features of this application.

What is claimed is:

1. A method of detecting smoke and flame, the method comprising the steps of:

receiving digitized images of a region to be monitored;

comparing pixels of one of said images with pixels of another said image according to two predetermined procedures to produce a flame present decision and a smoke present decision;

one said predetermined procedure which produces said flame present decision comprises the step of filtering said digitized images such that only changes in pixel characteristics occurring within a predetermined frequency band are used to produce said flame present decision: and providing a fire detected signal according to said smoke present and said flame present decisions.

2. A method as claimed in claim 1 in which the pixels of successive images are compared.

3. A method as claimed in claim 1, wherein said filtering step comprises filtering out changes in pixel characteristics occurring in the frequency band 1.25 to 4 Hz.

4. A method as claimed in claim 1, wherein said one procedure includes the step of determining the density of changes in pixel characteristics and determining the presence of a flame if a density in excess of a predetermined density value is determined.

* * * * *